United States Patent [19]

Ganser

[11] Patent Number: 5,018,925

[45] Date of Patent: May 28, 1991

[54] LIFTING DEVICE FOR A PLATFORM FOR STORAGE OF MOTOR VEHICLES

[75] Inventor: Anton Ganser, Friolzheim, Fed. Rep. of Germany

[73] Assignee: Otto Wohr GmbH, Fed. Rep. of Germany

[21] Appl. No.: 444,157

[22] PCT Filed: May 6, 1988

[86] PCT No.: PCT/EP88/00390

§ 371 Date: Nov. 28, 1989

§ 102(e) Date: Nov. 28, 1989

[87] PCT Pub. No.: WO88/09764

PCT Pub. Date: Dec. 15, 1988

[30] Foreign Application Priority Data

Jun. 4, 1987 [DE] Fed. Rep. of Germany ..... 3718738

[51] Int. Cl.[5] ..... B66F 7/02

[52] U.S. Cl. ..... 414/240; 187/8.59

[58] Field of Search ..... 414/233, 234, 239, 240, 414/331; 187/8.59, 8.41, 8.62

[56] References Cited

U.S. PATENT DOCUMENTS

| | | | |
|---|---|---|---|
| 1,710,442 | 4/1929 | Warshaw | 187/8.59 X |
| 1,912,149 | 5/1933 | Latimer | 187/11 |
| 2,139,597 | 12/1938 | Martin | 187/8.59 |
| 2,658,632 | 11/1953 | Baume | 414/240 |
| 2,824,654 | 2/1958 | Baume | 414/240 |
| 2,843,223 | 7/1958 | Villars | 187/8.59 X |
| 2,861,449 | 11/1958 | Cohan | 187/8.59 X |
| 2,891,636 | 6/1959 | Krieger et al. | 187/8.59 X |
| 3,985,207 | 10/1976 | Petit | 187/8.59 X |
| 4,674,938 | 6/1987 | Van Stokes et al. | 187/8.59 X |

FOREIGN PATENT DOCUMENTS

| | | | |
|---|---|---|---|
| 2015727 | 10/1971 | Fed. Rep. of Germany . | |
| 717691 | 1/1932 | France . | |
| 0063331 | 9/1955 | France | 187/8.59 |
| 1145939 | 10/1957 | France . | |
| 0657504 | 11/1963 | Italy | 414/240 |
| 0289616 | 2/1963 | Netherlands | 187/8.41 |
| 8701685 | 3/1987 | PCT Int'l Appl. . | |
| 493720 | 8/1970 | Switzerland . | |

OTHER PUBLICATIONS

Leaflet WOHR Auto-Parksystem COMBILIFT 543--Feb. 1985.

*Primary Examiner*—Frank E. Werner
*Assistant Examiner*—John VandenBosche
*Attorney, Agent, or Firm*—Barry R. Lipsitz

[57] ABSTRACT

In a lifting device for a platform for storage of motor vehicles wherein the platform is carried by carrying chains which are raised and lowered via driven chain wheels and are guided via deflection pulleys on the platform, in order to simplify the design and to enable lifting in the manner of a pulley block with only two carrying chains, it is suggested that there be arranged on each side of the platform a carrying chain, the one end of which is stationarily held in the region above a corner of a platform, from which it hangs downwards and passes over a first deflection pulley mounted for free rotation on a side of the platform, from which it runs over a second deflection pulley spaced from the first, thereby forming a loop in which the platform with the two deflection pulleys is suspended, is led upwards again where it passes over a stationarily mounted drive wheel, and with a gear which is connected to the second deflection pulley for common rotation with the latter and which meshes with a stationary toothed rack substantially parallel to the lifting path or with a stationarily held guiding chain, the respective one of which rests against the gear on the side thereof which faces away from the carrying chain.

17 Claims, 4 Drawing Sheets

LIFTING DEVICE FOR A PLATFORM FOR STORAGE OF MOTOR VEHICLES

Figure 1:
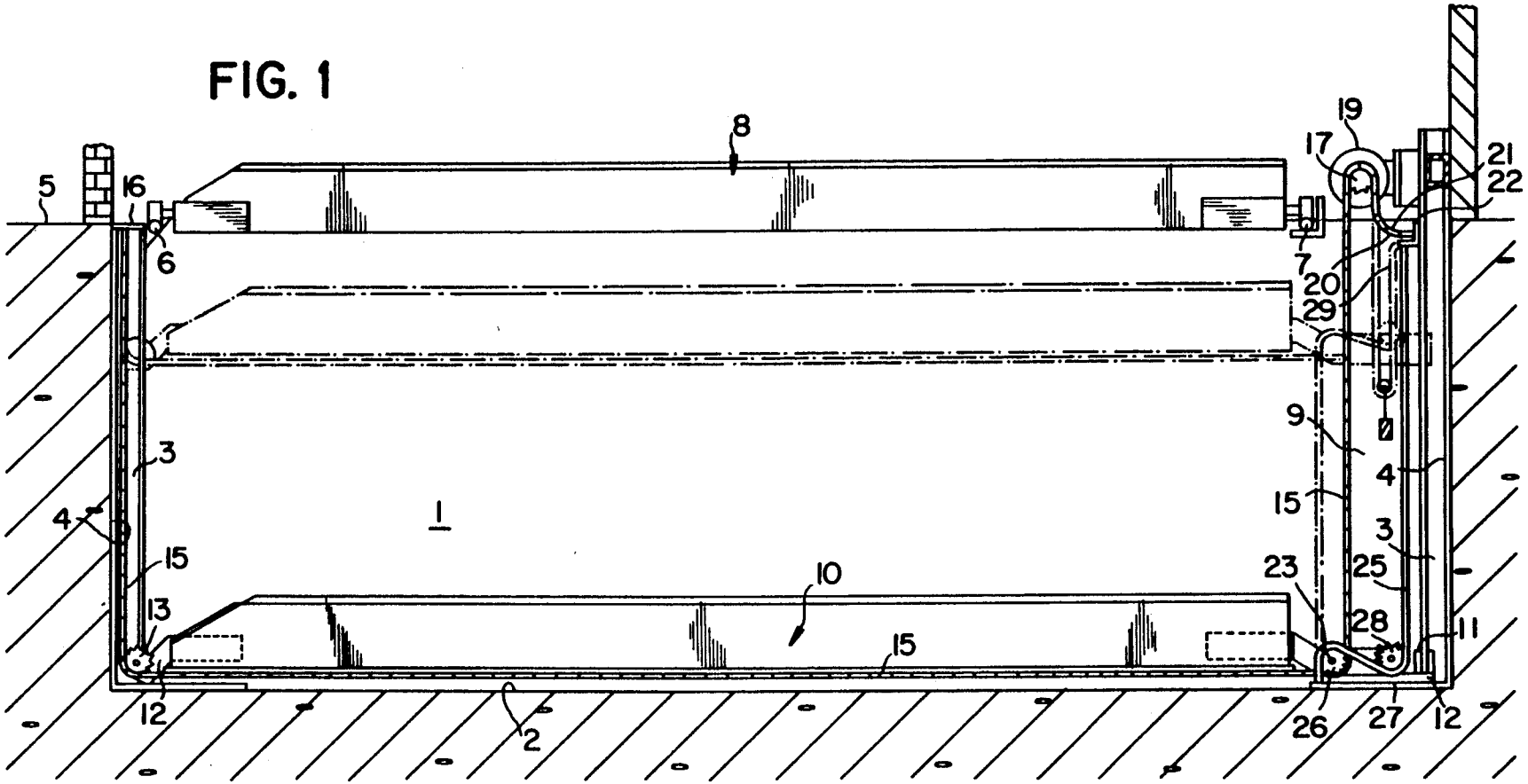

The invention relates to a lifting device for a platform for storage of motor vehicles.

Storage facilities for motor vehicles are known wherein the vehicles are stored on lifting platforms which are raised and lowered to a drive-in plane, as required, (Wöhr Auto-Parksysteme Combilift 543 prospectus of Otto Wöhr GmbH, February 1985).

Lifting devices are known wherein the platforms are held at all four corners on a chain or cable hoist, with the chain or cable hoists which engage the four corners being wound up and down synchronously. This requires a high degree of constructional expenditure since either each cable has to be provided with its own winding-up device or extensive deflection pulleys have to be arranged at the top for this purpose.

It is, furthermore, known to construct these individual cable hoists in accordance with the pulley block principle such that the chain or cable hoists are guided around additional deflection pulleys and so the forces required for the lifting can be reduced by increasing the winding-up path of the chain and cable hoists. When four separate chain or cable hoists are used, a considerable winding-up capacity is required, i.e., such arrangements involve high structural expenditure, apart from the fact that it is also difficult to ensure synchronous lifting motion of the four chain and cable hoists.

A motor vehicle parking system is described in WO87/0685 wherein the individual platforms are raised via carrying chains engaging one side of the platform, while a guiding chain above the platforms runs along the opposite side of the platform and is guided via deflection pulleys below the platform transversely to the latter.

In FR-A-713691, a lifting platform for motor vehicles is described which hangs in two carrying chains of loop-like design. Perpendicular supports are arranged on both sides of the platform to guide this platform and require considerable constructional expenditure.

DE-A-2 015 727 shows a parallel drive for lifting ramps or the like wherein two carrying chains are arranged on both sides of the lifting ramp or platform, each of which runs from a top point of attachment over two spaced deflection pulleys to a bottom point of attachment. The points of attachment are of stationary design; the lifting motion is brought about by the deflection pulleys being driven by a motor. For this purpose, the drive means must be arranged on the platform itself.

The object of the invention, proceeding from the lifting device known from FR-A-713691, is to create with simple structural means a lifting device wherein unwanted tilting of the platform about a platform axis extending transversely to the carrying chains is prevented, without elaborate guiding rods or the like being required therefor.

It is advantageous for the two deflection pulleys to be arranged at the front and rear corners of the platform. In this way, the vertical parts of the carrying chain can be arranged outside of the platform at the front and rear ends so that they are guided in the region of a frame or a wall of a building in which the installation is arranged. It is, furthermore, advantageous for the drive wheels of the carrying chains arranged on both sides of the platform to be held on a common drive shaft. This results in synchronism on both sides of the platform.

After winding around the drive wheels, the carrying chains can hang down loosely with their residual strand from the drive wheels. It is then advantageous for the ends of the residual strand to be held stationarily so that the residual strand forms between the drive wheel and the point of attachment a loop in which preferably a downwardly tensioned chain wheel is held. This tension can be achieved by, for example, simply suspending a counterweight on the loosely guided chain wheel.

If the gear which meshes with the toothed rack or the guiding chain has a pitch diameter which is identical with the diameter of the deflection pulley to which it is connected for common rotation, the inclination of the platform is maintained during the raising and lowering motion. However, an embodiment is particularly advantageous wherein the gear has a pitch diameter which differs from the diameter of the deflection pulley to which it is connected for common rotation. This enables the platform to be additionally pivoted about the transverse axis during the raising and lowering motion so the inclination of the platform can in this way be adjusted between the raised and the lowered positions. This can prove expedient for connecting a platform to an entrance and varying its incline in accordance with the conditions of the building in the parking position remote from the entrance.

If a guiding chain is used, it is advantageous for a chain which meshes with the gear to be guided over loose deflection pulleys arranged on the platform above and/or below the point of engagement in laterally offset relation to the latter. In this way, the guiding chain can also be placed in the proximity of an end wall or a supporting frame and so leaves the space beside the platforms substantially free. It is particularly advantageous for the chain to additionally wind around the top and/or the bottom of the gear. In such an embodiment, the guiding chain can, for example, rest against a carrier of a stationary frame and is only guided in the region of the platform itself around the gear arranged on the side of the latter.

If the gear is made to mesh with a toothed rack, it may be advantageous to mount the latter stationarily for pivotal motion at one side and to hold it in engagement with the gear by means of a guide. Even if the platform moves parallel to its longitudinal direction, for example, owing to a bent guide track, the engagement between gear and toothed rack is thereby reliably maintained.

Figure 2:
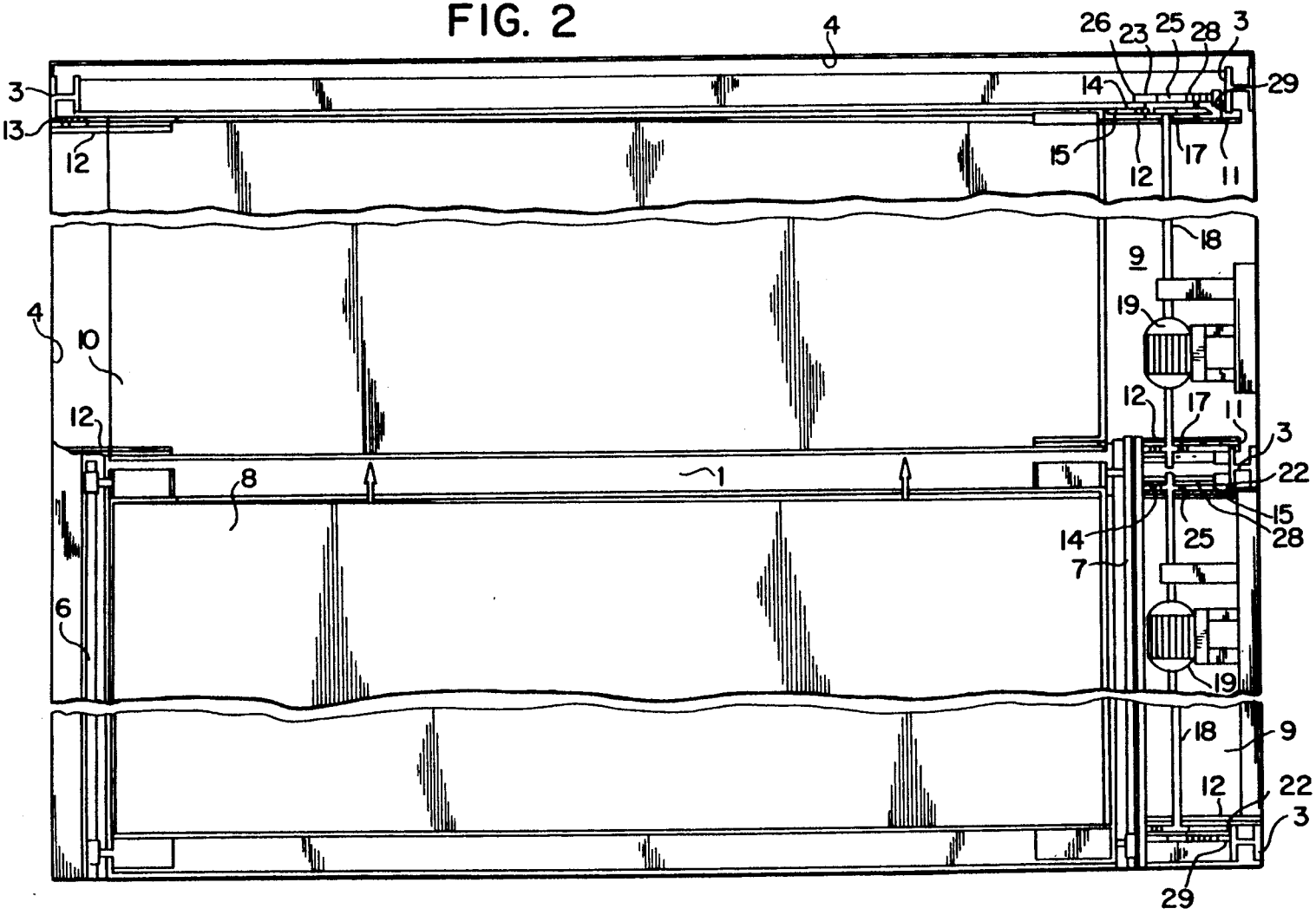
Figure 3:
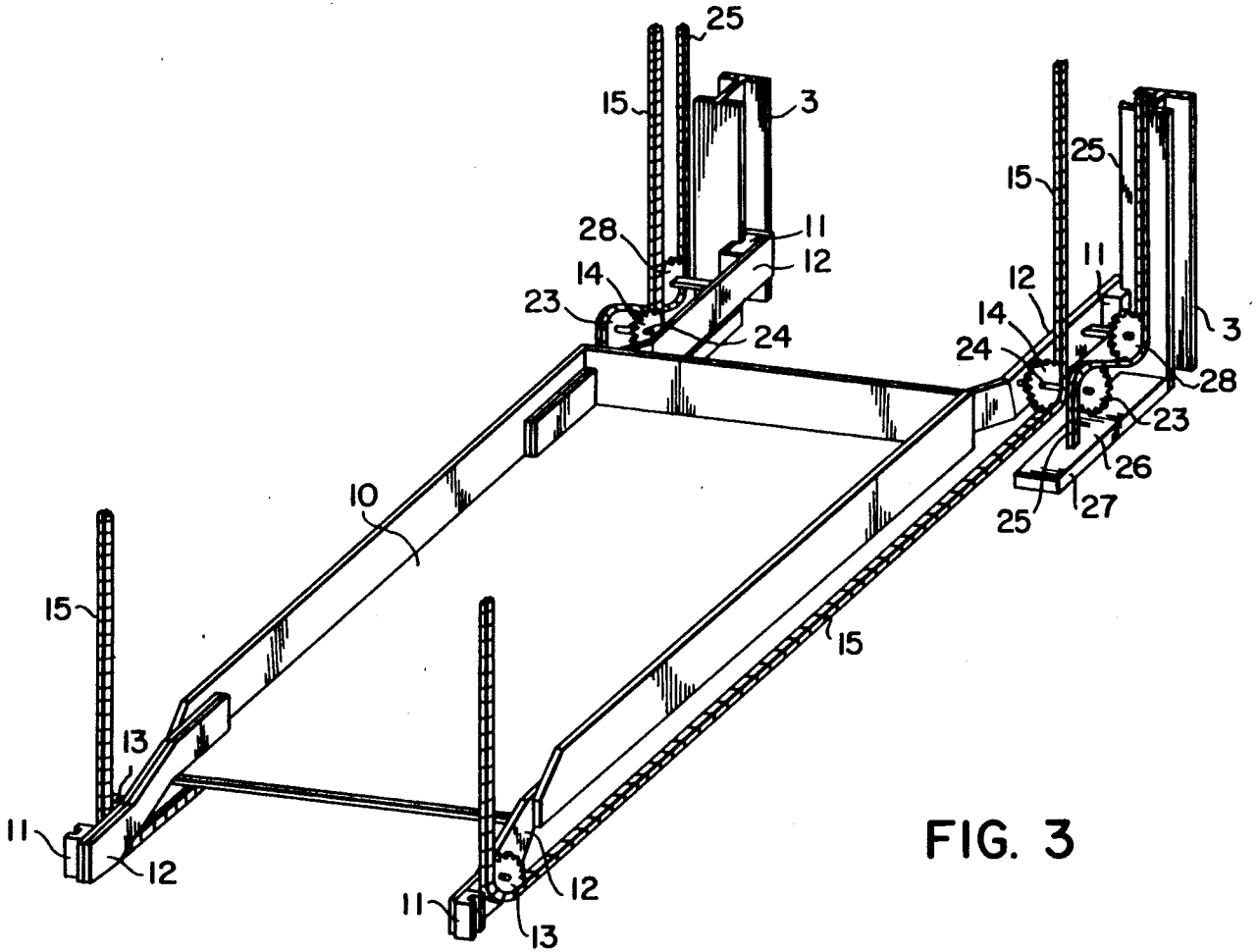
Figure 4:
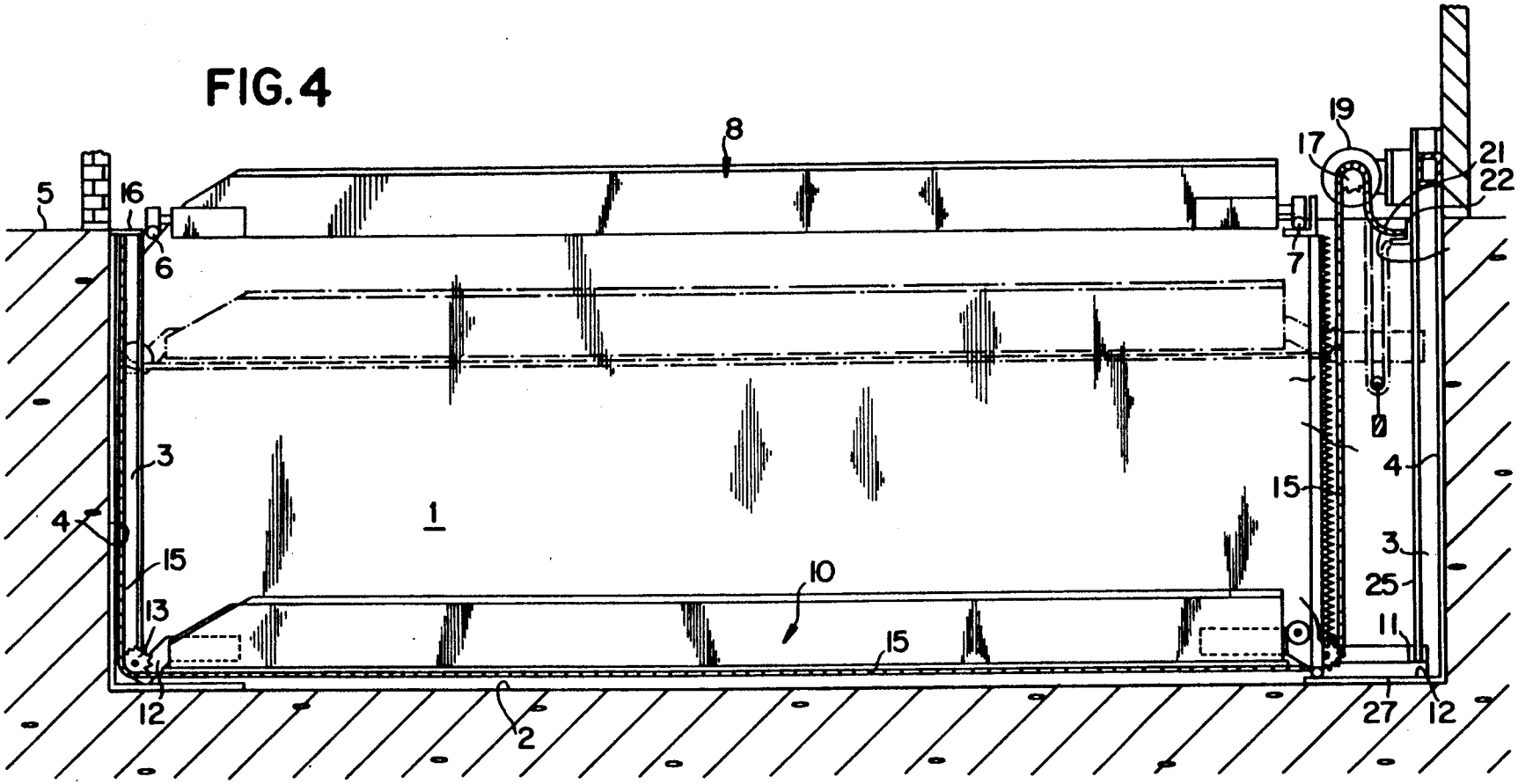

The following description of a preferred embodiment serves in conjunction with the drawings to explain the invention in further detail. The drawings show:

FIG. 1 a side view of a motor vehicle storage installation with an upper platform displaceable transversely to the drawing plane and with a lower platform raisable into the drive-in plane, with a single carrying chain at each platform side;

FIG. 2 a plan view of the installation of FIG. 1;

FIG. 3 a perspective view of the main driving parts of the lower platform; and FIG. 4 is a side view of an alternate embodiment of a motor vehicle storage installation having a stationary toothed rack substantially parallel to the lifting path.

The invention will be explained hereinbelow with reference to an installation for storing motor vehicles wherein horizontally displaceable platforms are mounted in a drive-in plane, while raisable platforms are arranged below this drive-in plane. It will, however, be understood that the described lifting device can also be used with other raisable or lowerable platforms for storing motor vehicles where no horizontally displaceable platforms are provided.

In the illustrated embodiment, the installation for storing motor vehicles is arranged in a pit 1 which has a floor 2 and is delimited by opposite walls 4. Four vertical posts with an I section are arranged at the corners of each storage compartment and extend from the floor 2 to a drive-in plane 5 which is located at at least the height of one motor vehicle above the floor 2. The posts 3 can also be of higher construction if yet a further storage plane is provided above the drive-in plane 5, but the principle underlying the invention will be explained with reference to a simpler embodiment wherein the posts extend to only approximately the drive-in plane 5.

Several storage compartments are arranged alongside one another, and the posts 3 between neighboring storage compartments are jointly associated with these neighboring storage compartments. Arranged on the top of posts 3, transversely to the longitudinal direction of the individual storage compartments, are horizontal rails 6 and 7 which extend over the entire width of the pit and on which platforms 8 run by means of suitable rollers and are thereby sidewardly displaceable. The number of platforms 8 in this plane is smaller by one than the number of storage compartments in order that the platforms 8 can be displaced in such a way that, if required, one storage compartment always remains free.

The rails 7 on the side of the storage compartment opposite the drive-in side are spaced from the corresponding posts 3 so as to leave between the rails 7 and the corresponding posts 3 at the end face of the platforms 8 a free space 9 in which the lifting device for a platform 10 arranged below the platforms 8 can be arranged. Such a platform 10 is associated with each storage compartment; it is guided by guide sockets 11 at its corners in the side walls of the posts 3 of I cross-sectional shape, as is particularly clear from FIG. 3. The guide sockets 11 are arranged at the free end of arms 12 which laterally adjoin the corners of the platform 10 (FIG. 3).

Two deflection pulleys 13 and 14 designed as chain wheels are arranged on each of the two outer sides of each platform 10. These deflection pulleys are mounted on the arms 12, i.e., they are located generally at the corners of the platform 10. The axis of rotation extends parallel to the rails 6 and 7.

A carrying chain 15 which forms part of the lifting device extends on both sides of each platform 10. This lifting device is provided in the same manner on both sides of platform 10; it will, therefore, be explained hereinbelow on one side only of the platform 10. The carrying chain 15 is attached at its one end 16 to the top of a post 3 which is located at the end of the pit 1 opposite the space 9. The carrying chain extends immediately beside the post 3 vertically downwardly and runs around the deflection pulley 13 to the rear deflection pulley 14 from which it runs vertically upwardly again to a drive chain wheel 17 around the top of which it winds. The drive chain wheel 17 is mounted behind the top platform 10 in the space 9 at the level of the drive-in plane 5 on a drive shaft 18 for common rotation with the latter. The drive shaft 18 extends over the entire width of the platform 10 and is rotatable by a drive motor 19. Seated on the drive shaft 18, on the other side of the platform 10, is the corresponding drive chain wheel for the carrying chain arranged on the other side.

After winding around the drive chain wheel 17, the free end or residual strand 20 of the drive chain hangs vertically downwards and forms a loop 21, with the end 22 attached to the rear post 3 (FIG. 1). A tensioning wheel, not illustrated in the drawings, with, for example, a counterweight suspended from it, can be mounted in the loop 21.

Owing to the mounting described above, the carrying chains 15 form on both sides of the platform 10 a loop in which the platform is suspended by means of its deflection pulleys 13 and 14. Since the platform 10 is not fixed along the carrying chain 15, it can pivot about a transverse axis extending parallel to the drive shaft 18 when the platform is subjected to greater load at the front or rear end than at the opposite end.

In order to avoid such unintentional pivoting, there is connected to the respective rear deflection pulley 14 for common rotation with the latter a gear 23 which is, for example, located on the same bearing shaft 24 (FIG. 3). Wound around this gear 23 in the form of a chain wheel is a guiding chain 25, the one end 26 of which is fixed to the floor 2 or to a foot part 27 connected to the post 3, from there winds vertically upwards around the gear 23, is vertically upwardly deflected around a deflection pulley 28 mounted for free rotation on the arm 12, and the other end 29 of which is attached to the top of the post 3. Hence this guiding chain 25 runs substantially vertically, with the two vertical parts being offset laterally in relation to each other by the deflection pulley 28 and the gear 23. The guiding chain 25 winds around the gear 23 on the side facing away from the winding of the carrying chain 15 around the deflection pulley 14.

During operation, the platform 10 is normally in the lower position illustrated in FIG. 1 in which it rests, for example, by means of the arms 12 on the foot parts 27. In order to raise it, the platform 8 arranged above it is first moved sideways- to create a free space above the platform 10 which is to be raised. The drive motor 19 is then actuated such that the two drive chain wheels 17 displace the carrying chains 15 running over them in such a way that the loops passing around the deflection pulleys 13 and 14 are shortened and the slack loops 21 extended. The bottom platform 10 is thereby raised; this platform 10 is illustrated in a raised position by dot-and-dash lines, and similarly the associated carrying chains 15. During the raising operation, the gear 23 meshes in the guiding chain 25. The position of the gear 23 for each height is thereby clearly defined, more specifically, on the one hand, by the guiding chain 25 and, on the other hand, by the deflection pulley 14 which is connected to the gear 23 for common rotation with it engaging in the carrying chain 15. This ensures that the platform 10 can also not pivot about its transverse axis in the raised position. The guiding chain 25 is also shown in dot-and-dash lines for the raised position of the platform in FIG. 1.

In the embodiment illustrated in FIG. 1, the platform 10 is raised parallel to itself during the lifting operation, i.e., without pivoting about the central transverse axis. This is the case when the pitch diameter of the deflection pulley 14 coincides with the pitch diameter of the gear 23. If these pitch diameters are chosen so as to differ from each other, the platform pivots about the central transverse axis during the lifting operation, i.e., the platform is pivoted about this central transverse axis in a precisely defined manner. This may be desired in certain applications, for example, to connect the front end of the platform to the drive-in plane 5 before the platform 10 is raised throughout its entire length to the drive-in plane 5.

In the illustrated embodiment, the guiding chain 25 is laterally offset in the bottom and top parts thereof by the gear 23 and the deflection pulley 28. By means of a second deflection pulley underneath the deflection pulley 28, the bottom part of the guiding chain 25 could also be arranged exactly underneath the top part of the guiding chain 25; this guiding chain would then merely form a loop winding around the gear 23 between the two deflection pulleys.

In a modification of the embodiment of FIG. 1, the guiding chain 25 could also be replaced by a toothed rack 25*a* with which the gear 23 meshes as shown in FIG. 4. This toothed rack could be arranged vertically and stationarily in the pit; it could also be mounted stationarily so as to pivot at one side, and a guide could then be provided to keep the pivotable toothed rack in engagement with the gear 23.

All of the components of the lifting device, i.e., drive motor, drive shaft, drive chain wheels and deflection pulleys including the guiding chain can be arranged in the space 9 behind the platform so that the top platforms 8 can be moved sidewards in an unimpeded manner by the lifting device. A platform corresponding to the platform 10 with an associated lifting device could also be arranged above the platform 8 and then correspondingly lowered when the platform 8 is moved sidewards.

Only two carrying chains are required for this arrangement and so the winding-up operation can be simplified in comparison with known devices where four chains are used. The guiding chain can be of substantially weaker design than the two carrying chains as it merely serves to guide the platform along the carrying chain, but does not carry it. In all, a structurally simple and yet reliable arrangement is obtained, with the synchronism on both sides being simultaneously ensured by the connection via the drive shaft.

It is also very important that the parts of the lifting device arranged on the platform 10 itself can be arranged beside the platform, i.e., they require no additional construction depth in the pit 1. The pit depth 1 can thus be fully exploited.

I claim:

1. Lifting device for a platform (10) for storage of motor vehicles wherein there is arranged on each of two opposite sides of the platform (10) a carrying chain (15), the one end of which is stationarily held in the region above a corner of the platform (10), from which it hangs downwards and passes over a first deflection pulley (13) mounted for free rotation on a side of the platform (10) and then runs over a second deflection pulley (14) spaced from the first deflection pulley (13), each carrying chain (15) forming in the region of the platform a loop in which the platform (10) with the two deflection pulleys (13, 14) is suspended, and after the second deflection pulley (14) is led upwards again where it passes over a stationarily mounted drive wheel (17), characterized in that a gear (23) connected to the second deflection pulley (14) for common rotation with the latter is provided to mesh with a stationarily held guiding chain (25) which rests against the gear (23) on the side thereof which faces away from the carrying chain (15).

2. Device according to claim 1, characterized in that the two deflection pulleys (13, 14) are arranged at the front and rear corners of the platform (10).

3. Device according to claim 1, characterized in that the drive wheels (17) of the carrying chains (15) arranged on both sides of the platform (10) are held on a common drive shaft (18).

4. Device according to claim 1, characterized in that after winding around the drive wheels (17), the carrying chains (15) hang down loosely with their residual strand (20) from the drive wheels (17).

5. Device according to claim 4, characterized in that the ends (22) of the residual strand (20) are held stationarily so that the residual strand (20) forms a loop (21) between drive wheel (17) and point of attachment.

6. Device according to claim 5, characterized in that a downwardly tensioned chain wheel is held in the loop 21.

7. Device according to claim 1, characterized in that the gear (23) has a pitch diameter which differs from the diameter of the deflection pulley (14) to which it is connected for common rotation therewith.

8. Device according to claim 1, characterized in that a guiding chain (25) which meshes with the gear (23) is guided over loose deflection pulleys (28) arranged on the platform (10) in laterally spaced relation to the gear.

9. Device according to claim 8, characterized in that the guiding chain (25) winds additionally around the gear (23).

10. Device according to claim 1, characterized in that the toothed rack is stationarily mounted so as to pivot on one side and is held in engagement with the gear (23) by a guide.

11. Lifting device for a platform (10) for storage of motor vehicles wherein there is arranged on each of two opposite sides of the platform (10) a carrying chain (15), the one end of which is stationarily held in the region above a corner of the platform (10), from which it hangs downwards and passes over a first deflection pulley (13) mounted for free rotation on a side of the platform (10) and then runs over a second deflection pulley (14) spaced from the first deflection pulley (13), each carrying chain (15) forming in the region of the platform a loop in which the platform (10) with the two deflection pulleys (13, 14) is suspended, and after the second deflection pulley (14) is led upwards again where it passes over a stationarily mounted drive wheel (17), characterized in that a gear (23) connected to the second deflection pulley (14) for common rotation with the latter is provided to mesh with a stationary toothed rack substantially parallel to the lifting path which rests against the gear (23) on the side thereof which faces away from the carrying chain (15).

12. Device according to claim 11, characterized in that the two deflection pulleys (13, 14) are arranged at the front and rear corners of the platform (10).

13. Device according to claim 11, characterized in that the drive wheels (17) of the carrying chains (15) arranged on both sides of the platform (10) are held on a common drive shaft (18).

14. Device according to claim 11, characterized in that after winding around the drive wheels (17), the carrying chains (15) hang down loosely with their residual strand (20) from the drive wheels (17).

15. Device according to claim 14, characterized in that the ends (22) of the residual strand (20) are held stationarily so that the residual strand (20) forms a loop (21) between drive wheel (17) and point of attachment.

16. Device according to claim 15, characterized in that a downwardly tensioned chain wheel is held in the loop (21).

17. Device according to claim 11, characterized in that the gear (23) has a pitch diameter which differs from the diameter of the deflection pulley (14) to which it is connected for common rotation therewith.

* * * * *